US005225259A

United States Patent [19]

Akao

[11] Patent Number: 5,225,259

[45] Date of Patent: Jul. 6, 1993

[54] CONTAINER CAP FOR PHOTOGRAPHIC FILM CARTRIDGE

[75] Inventor: Mutsuo Akao, Kanagawa, Japan

[73] Assignee: Fuji Photo Film Co., Ltd., Minami-ashigara, Japan

[21] Appl. No.: 574,779

[22] Filed: Aug. 30, 1990

[30] Foreign Application Priority Data

Aug. 31, 1989 [JP] Japan ..... 1-222932

[51] Int. Cl.[5] ..... B65D 85/00

[52] U.S. Cl. ..... 428/36.92; 428/64; 524/580; 206/407; 206/316.1

[58] Field of Search ..... 428/64, 36.92; 206/407, 206/316.1; 524/580

[56] References Cited

U.S. PATENT DOCUMENTS 4,639,386 1/1987 Akao ..... 428/35
4,844,961 7/1989 Akao ..... 428/36.92
4,960,626 10/1990 Akao et al. ..... 428/36.92

*Primary Examiner*—Alexander S. Thomas
*Attorney, Agent, or Firm*—Burns, Doane, Swecker & Mathis

[57] ABSTRACT

A cap of a container for a photographic film cartridge is disclosed, which comprises a polyethylene resin having 4 to 60 g/10 minutes of melt index, more than 4000 g/cm$^2$ of bending elastic modulus, more than 55 D of Shore hardness and more than 70% crystallinity. Therefore, the cap is produced without coloring troubles or molding troubles even if it does not contain a lubricant and has a sufficient fitting strength at a high temperature.

5 Claims, 2 Drawing Sheets

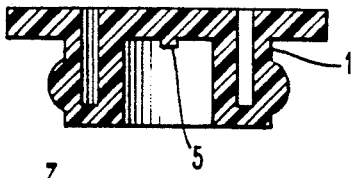
Fig. 1
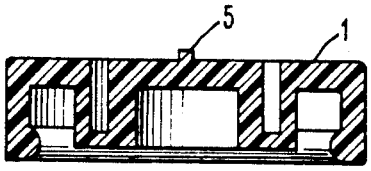
Fig. 2
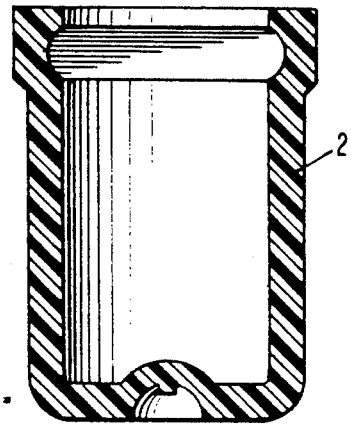
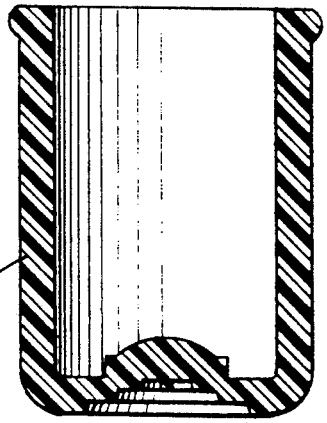
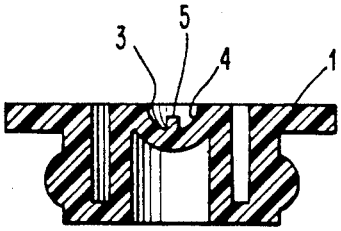
Fig. 3
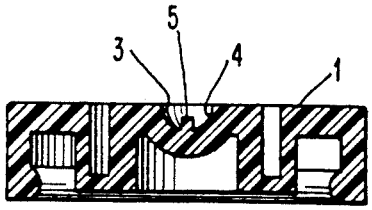
Fig. 4
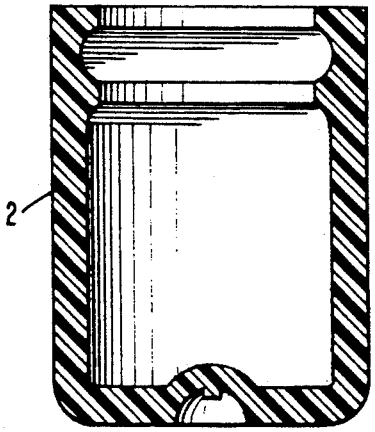
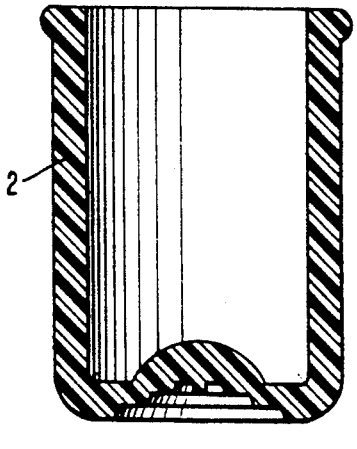

CONTAINER CAP FOR PHOTOGRAPHIC FILM CARTRIDGE

BACKGROUND OF THE INVENTION

1. Field of the Invention

This invention relates to a cap of a container for a photographic film cartridge.

2. Description of the Prior Art

A conventional cap of the container for a photographic film cartridge was usually made of high-pressure branched low-density polyethylene (LDPE) resin which is 0.927 g/cm$^3$ density (ASTM D 1505) and 4.0 g/10 minutes in melt index (ASTM D1238, at 190° C., MI). This resin is superior in flexibility at a low temperature, fitness of cap and body, compressive strength, and with small burr and gate marks.

Moreover, the inventor disclosed a cap of a container for a photographic film having 1200 to 4000 kg/cm$^2$ of a bending rigidity (ASTM D-747) made of LDPE resin which is 0.918 to 0.930 g/cm$^3$ in density and 7 to 40 g/10 minutes, in MI containing 0.05 to 1 wt. % of fatty amide lubricant in Japanese Patent KOKAI No. 62-291639. Another cap of a container for a photographic film disclosed in Japanese Patent KOKAI No. 63-113453 is made of LDPE resin having 0.920 to 0.935 g/cm$^3$ in density, 10 to 50 g/10 minutes in MI and 3.8 to 8.5 in molecular weight distribution and containing 0.01 to 0.9 wt. % of a lubricant.

However, in the case of using the LDPE resin, molding troubles, such as a short shot of the molten resin, warp, twist and deformation, frequently occur. Its insufficient heat stability was also a problem. That is, the LDPE resin residing in a continuous molding machine at its screw, manifold, hot runner or other places was gradually colored brown or dark brown by heat. This colored resin was gradually extruded to cause coloring troubles.

Particularly in a transparent or translucent cap not colored. The occurrence of coloring trouble is at a high rate, i.e. 3 to 10%. As a result, total inspection of the molded caps was e necessary. Moreover, in the case of a colored cap, the yellowed resin in a state of lumps stayed at the nozzle portion, and the resin flow came to be inferior resulting in a short shot, and in a particular case causing the lack, of the molten resin.

In the caps disclosed in Japanese Patent KOKAI Nos. 62-291639 and 63-113453 by the inventor, the above problems were solved, but some problems described below occurred caused by using a LDPE resin and a lubricant. That is, the fitting strength decreases at high temperature, for example, 2.5 kg at −10° C., 1.8 kg at 20° C., 0.8 kg at 35° C. and 0.5 kg at 50° C., that is, the fitting strength at 50° C. is 1/5 of that at −10° C. As a result, the cap is liable to detach by the water vapor pressure in the container. Other problems also occurred such as deformation under heat, scratches and deformation generated during high speed mass molding or pneumatic transportation, scratches and abrasion by collisions and rubbing with other bodies, the increase of the blending cost of a lubricant, the adhesion of dust and white powder to a photographic film caused by bleeding out of the lubricant, gradual increase of haze and gradual color change. Moreover, in the case that the content of the lubricant is insufficient or the lubricant is not uniformly dispersed, the release of the cap from the mold or the deformation of the cap are liable to occur unless the molding cycle is extended.

SUMMARY OF THE INVENTION

An object of the invention is to provide cap of a container for a photographic film cartridge which is produced without coloring troubles or molding troubles even if it does not contain a lubricant and has a sufficient fitting strength at a high temperature.

Such an object has been achieved by a cap containing a U polyethylene resin having special properties.

That is, the present invention provides a cap of a container for a photographic film cartridge which comprises polyethylene resin having 4 to 60 g/10 minutes of melt index, more than 4000k/gcm$^2$ of bending elastic modulus, more than 55 D of Shore hardness and more than 70% crystallinity.

BRIEF DESCRIPTION OF THE DRAWINGS

FIGS. 1 to 4 are sectional side views indicating several examples of the container to which the present invention is applied.

Figure 5:
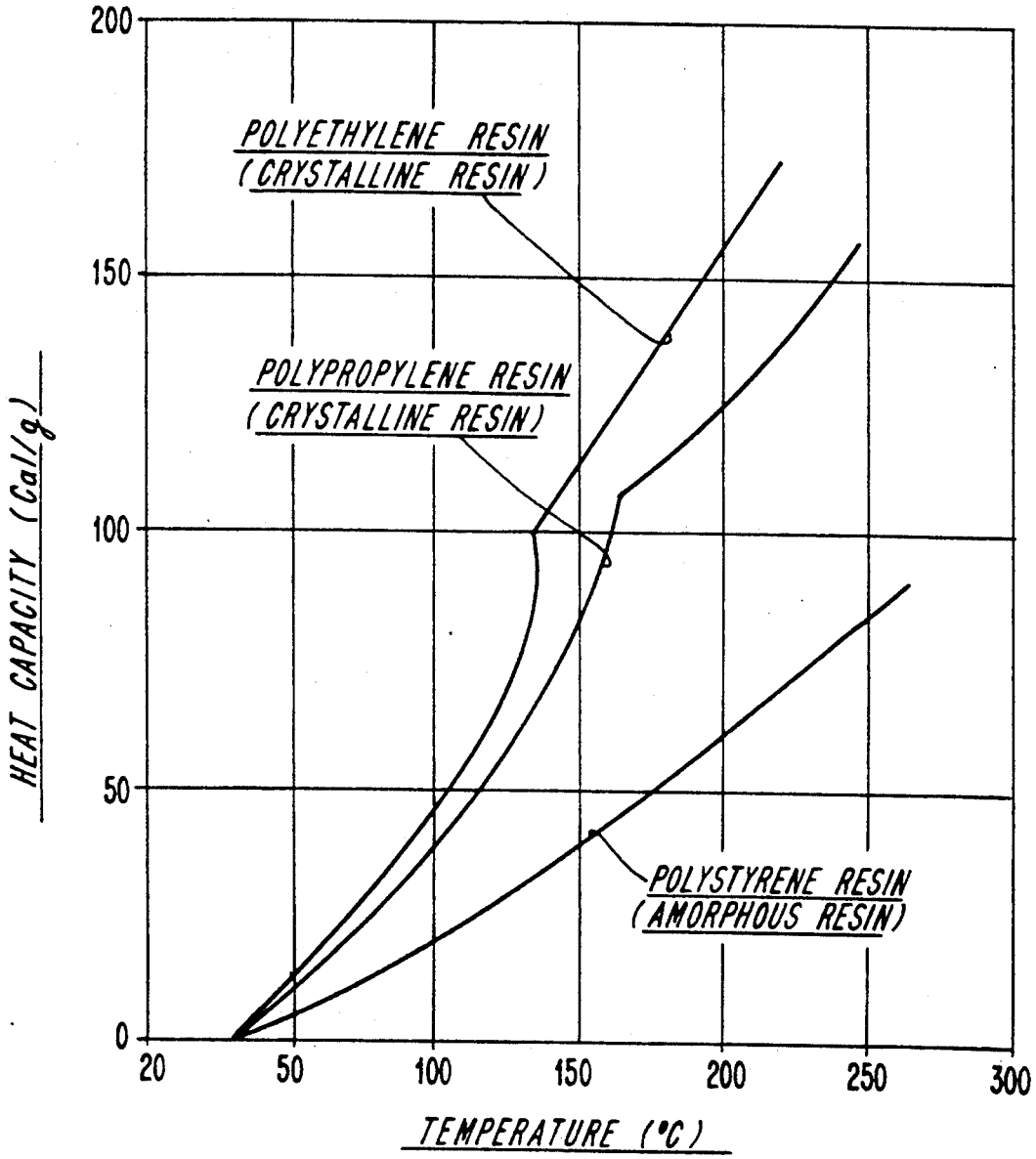
FIG. 5 is a graph representing the quantity of heat necessary for the plasticization and the quantity of heat necessary to be removed by cooling during injection molding.

1: Cap of a container for a photographic film cartridge

2: Body of a container for a photographic film cartridge

DETAILED DESCRIPTION OF THE INVENTION

The polyethylene resin used in the invention contains more than 50 wt. % of homo-polyethylene resin and/or a an ethylene-α-olefin copolymer resin. The homopolyethylene resins are produced by a polymerization of ethylene molecules, and are divided into low density polyethylene (LDPE) resins and medium/high density polyethylene (MDPE, HDPE) resins according to the density.

HDPE resins are preferred. With respect to the manufacturing process, the homopolyethylene resins are divided into about two groups. One is the low-pressure process polyethylene resin produced by polymerizing ethylene molecules by the solvent slurry method under one to several atmospheric pressures at about 70° C. to 100° C. using a Ziegler catalyst. The other is the medium-pressure process polyethylene resin produced by polymerizing ethylene molecules by solution polymerization under 18 to 35 atmospheric pressures at 130° to 200° C. using a catalyst such as chromium oxide.

The ethylene-α-olefin copolymer resin is a copolymer resin polymerized using ethylene and α-olefin as the comonomer. Most of them are produced by the low pressure process similar to HDPE resin, and a part of them are produced by the modified high-pressure process. The molecular structure of the ethylene-α-olefin copolymer resin is linear similar to the HDPE resin rather than to the LDPE resin, and is also called linear low density polyethylene (L-LDPE) resin. The number of the carbon atoms in the α-olefin is preferably 3 to 13.

The polyethylene resin may be a homopolyethylene resin, an ethylene-α-olefin copolymer resin or a blended resin thereof. Moreover, the polyethylene resin may contain various additives and thermoplastic resins provided that the sum of the homopolyethylene resin and the ethylene-α-olefin copolymer resin is more than 50 wt. %.

The melt index (MI) of the polyethylene resin is 4 to 60 g/10 minutes, preferably 5 to 35 g/10 minutes, particularly preferably 7 to 25 g/10 minutes. In the case of less than 4 g/10 minutes, the polyethylene resin is a crystalline resin needing a thermal capacity of two times as large as the amorphous resin as shown in FIG. 5. As a result, the period for plasticization and cooling and the molding cycle tend to be long. In the case of the injection molding process suitable to the invention using a multicavity metal mold such as not less than 16 pieces per cycle, the fluidity of the molten resin becomes worse, and molding troubles such as resin yellowing, warp, twist and short shot, occur. Thus, total visual inspection of the molding products is necessary, and the manufacturing cost is high. On the other hand, in the case of higher than 60 g/10 minutes, the physical strength decreases, and lubricant or the like bleeds out. If a lubricant is not added, molding troubles, such as the collapse of the rib of the cap and short shot, resin residue at gate and burrs, frequently occur by the decrease of rigidity.

The bending elastic modulus (ASTM D-747) of the polyethylene resin is more than 4000 kg/cm$^2$. In the case of less than 4000 kg/cm$^2$ the crystallinity of the resin is small and the surface hardness is small. The releasability from the mold is inferior. As a result, there are various problems similar to the case of lower than 0.935 g/cm$^3$ of the resin density described later.

The Shore hardness (ASTM D-2240) of the polyethylene resin is more than 55 D. In the case of less than 55 D, if a lubricant having a rapid effect is not added, white powders are frequently generated caused by scratching or wear. The cooling period should be long so that the molded product is not easily detached from the metal mold, and when the molded product is detached by force, deformation, collapse of rib or scratches frequently occur.

The crystallinity of the polyethylene resin is more than 70%, which is measured by the X-ray diffraction method. In the case of lower than 70%, when a lubricant having a rapid effect is not added, the cap should be cooled to 35° C. so that it is detached from the metal mold without defects. When the cap is detached at a higher temperature, the deformation, the collapse of the rib, scratches or abrasion occur. Moreover, when the cap is placed in or out of a house at higher than 30° C., fitting strength decreases and the detachment of cap frequently occurs caused by the dropping the container or due to the water vapor pressure in the container.

The density of the polyethylene resin is preferably 0.935 to 0.970 g/cm$^3$, particularly preferably 0.940 to 0.962 g/cm$^3$ In the case of lower than 0.935 g/cm$^3$, scratches and abrasion are liable to occur, unless a lubricant which is liable to bleed and has a rapid effect such as a fatty amide lubricant is added, the release of the cap from the mold is inferior. Since the crystallization speed is low, the cooling period should be long so as to prevent molding troubles. In the case of more than 0.970 g/cm$^3$, since molecular orientation is liable to occur, the cap is broken at the weld line portions. The rate of the mold shrinkage is great, and since the slipping and rigidity become too large, the fitting strength is small, and the cap is liable to be detached.

The polyethylene resin of the cap may contain various additives described in Japanese Patent KOKAI No. 62-291639, and No. 63-113453, Japanese Patent Application No. 63-67308 and No. 1-11846. For example, an antioxidant, a coloring material, a nucleating agent, additives and various thermoplastic resin can be added. Moreover, if necessary, various lubricants or surfactants having lubricating ability may be present.

The cap of the invention is a fitting type. Its form is not limited, and the caps in FIGS. 1 and 4 are preferable in view of good fitness to the body of the container to bring sufficient sealing and readiness of detachment. In the drawings, 1 represents the cap, 2 represents the container body. Particularly, the caps of FIGS. 1 and 3 are preferable because it can be detached by one hand. As shown in FIGS. 3 and 4, an indent 3 may be formed around a gate mark 5, and the gate mark 5 is provided in it so as not to project out. This structure is preferable in points of appearance and molding. Since the gate mark 5 does not project out, its after-treatment is not necessary. Stringiness trouble also decreases.

The cap as well as the body of the container may be produced by multicavity injection molding. The molding method of the cap is not limited, and the cap may be produced by hot runner type injection molding, inter mold vacuum injection molding or stack molding. Particularly, hot runner type injection molding using a mold having more than 24 cavities is preferred, and among them stack molding using a mold having more than 16 cavities on one side is preferred. In the stack molding more than 32 of products are molded at one shot.

In the cap of the invention, since the polyethylene resin of the cap has a high MI, a high bending elastic modulus, a high hardness and a high crystallinity, the melt viscosity is small, and the fluidity is excellent. Therefore, the cap can be molded at a low temperature. Since the crystallization speed is high, when the cooling period is short, scratches, deformation and collapse of the rib do not occur due to the excellent releasability. Since the crystallinity is high, the heat resistance is improved and in the case of an ambient temperature of at more than 35° C., the fitting strength slightly decreases and the detachment of the cap and the deformation do not occur.

EXAMPLE

Example I

The polyethylene resin used was composed of 85 wt. % of homopolyethylene resin and 15 wt. % of ethylene-4-methylpentene copolymer resin. The homopolyethylene resin had 20 g/10 minutes of MI, 0.965 g/cm$^3$ of density, 10,500 kg/cm$^2$ of bending elastic modulus, 72 D of Shore hardness and 87% of crystallinity, and was produced by a low-pressure process (Ziegler process). The ethylene-4-methylpentene copolymer resin had 18 g/10 minutes of MI, 0.92 g/cm$^3$ of density, 2200 kg/cm$^2$ of bending elastic modulus, 50 D of Shore hardness and 65% of crystallinity.

The cap of a container for a photographic film cartidge shown in FIG. 3 was formed by using a closed system injection molding machine ("Sumitomo Netstal with SYCAP" manufactured by Sumitomo Heavy Industries Ltd. at a mold clamping pressure of 150 t. The molding number per cycle was 24, and the type of runner was a hot runner. The resin temperature was 190° C., and the cooling temperature was 15° C. The cooling time was 1.6 seconds, and the molding cycle was 7.0 seconds.

Since the obtained cap did not contain a fatty amide lubricant which was liable to bleed out and had a rapid effect, the bleeding out of additives was small after molding. Therefore, the adhesion of dust to the photographic film did not occur and a photographic film was not affected adversely. Physical strength, fitness strength and hardness were excellent in the wide range from −20° C. to 70° C. Therefore, when the container dropped or rubbed against the chute, white powder and scratches did not occur. Moreover, since the cap had a high rigidity and a high crystallinity, when the molded product was cooled to about 40° C., the releasability from the mold was excellent and the deformation and the collapse of the rib rarely occurred. As a result, the cooling period together with the molding cycle was sharply reduced. Moreover, since molding troubles were sharply reduced, the total visual inspection of the caps was not necessary.

As a result of the reduction of the molding cost and the exclusion of the lubricant having a rapid effect, the material cost was decreased, and molding troubles were sharply reduced. The material loss and the inspecting cost were reduced, and a cheap cap having a high quality was obtained.

Example II

A cap shown in FIG. 3 was formed by the molding machine, the mold and the manufacturing conditions as same as Example I using a low-pressure process ethylene-butene-1 copolymer resin haing 25 g/10 mintes of MI, 5,3000 kg/cm$^2$ of bending elastic modulus, 63 D of Shore hardness and 75% of crystallinity.

The obtained cap had an excellent quality similar to Example I. Since molding troubles hardly occurred the total inspection of the products was not necessary.

Example III

A cap shown in FIG. 3 was formed by the molding machine, the mold and the manufacturing conditions as same as Example I using a homopolyethylene resin having 9 g/10 minutes of MI, 9,000 kg/cm$^2$ of bending elastic modulus, 70 D of Shore hardness and 85% of crystallinity.

The obtained cap had an excellent quality similar to Example I. Since molding troubles hardly occurred the total inspection of the products was not necessary.

I claim:

1. In a container for a photographic film cartridge having a body and a cap, said cap being fitted to said body and being comprised of a polyethylene resin having 4 to 60 g/10 minutes of melt index, more than 4000 kg/cm$^2$ of bending elastic modulus, more than 55 D of Shore hardness and more than 70% crystallinity.

2. The cap of a container for a photographic film cartridge of claim 1 wherein said polyethylene resin has more than 50 wt. % of at least one of a nomopolyethylene resin a ethylene-α-olefin copolymer resin.

3. The cap of a container for a photographic film cartridge of claim 1 wherein said polyethylene resin has 5 to 35 g/10 minutes of melt index.

4. The cap of a container for a photographic film cartridge of claim 1 wherein said polyethylene resin has 0.935 to 0.970 g/cm$^3$ of density.

5. The cap of a container for a photographic film cartridge of claim 1 wherein said polyethylene resin has an antioxidant, a coloring material or a nucleating agent.

* * * * *